10/22/85 OR 4,548,380

United States Patent [19]

Cooper et al.

[11] Patent Number: 4,548,380

[45] Date of Patent: Oct. 22, 1985

[54] HOLDING DEVICE FOR HOT TOP LINING SLABS

[75] Inventors: Kenneth C. Cooper, Hamilton; William Pollard, Guelph, both of Canada

[73] Assignee: FOSECO International Ltd., Birmingham, England

[21] Appl. No.: 469,309

[22] Filed: Feb. 24, 1983

Related U.S. Application Data

[63] Continuation of Ser. No. 262,707, May 11, 1981, abandoned.

[30] Foreign Application Priority Data

May 17, 1980 [GB] United Kingdom ..... 8016383

[51] Int. Cl.[4] ..... B22D 7/10

[52] U.S. Cl. ..... 249/106; 249/198

[58] Field of Search ..... 249/197-202, 249/106, DIG. 5

[56] References Cited

U.S. PATENT DOCUMENTS

| | | | |
|---|---|---|---|
| 3,966,167 | 6/1976 | Vayda | 249/198 |
| 3,972,502 | 8/1976 | Korhel | 249/198 |
| 4,083,528 | 4/1978 | Anthony, Jr. et al. | 249/198 |
| 4,131,262 | 12/1978 | Bowers | 249/198 X |

FOREIGN PATENT DOCUMENTS

| | | | |
|---|---|---|---|
| 1261633 | 2/1968 | Fed. Rep. of Germany | 249/198 |
| 1106104 | 3/1968 | United Kingdom . | |
| 1544273 | 4/1979 | United Kingdom . | |

*Primary Examiner*—Nicholas P. Godici
*Assistant Examiner*—J. Reed Batten, Jr.
*Attorney, Agent, or Firm*—Cushman, Darby & Cushman

[57] ABSTRACT

A device for holding hot top lining slab (1) in ingot mould head comprises strap-receiving portion (4) and strap (3), either being securable to the slab, in which the portion (4) includes latch part (11) extending towards path of movement of the strap (3) when receiving in the portion (4) and the strap (3) has disposed on a side thereof a plurality of spaced apart latching parts (8) complementary to the latch part (11) of the portion (4), with another side of the strap (3) being free of such latching parts, whereby when a side of the strap (3) free of latching parts is presented to the latch part (11) of the portion (4), the strap (3) is free to move through that portion and when the strap (3) is moved to present a side having the latching parts (8) to the latch part (11) of the portion (4), the strap (3) is caused to engage with the portion (4).

5 Claims, 3 Drawing Figures

HOLDING DEVICE FOR HOT TOP LINING SLABS

Figure 1:
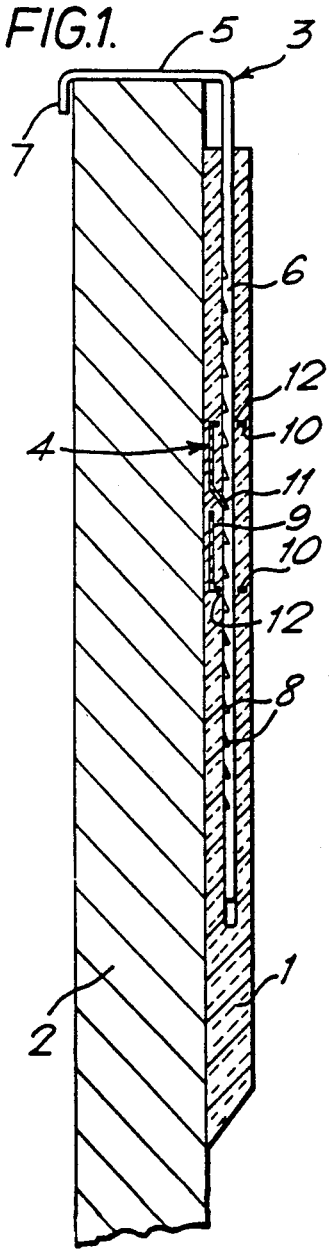

This is a continuation of application Ser. No. 262,707, filed May 11, 1981 and now abandoned.

The invention concerns holding means for hot top lining slabs, hot top lining slabs having the holding means and ingot moulds having hot top linings provided by use of the slabs having the holding means.

In the casting of steel ingots, refractory, heat-insulating slabs are often positioned in the head of the ingot mould to form a hot top lining. The purpose of such a lining is to reduce the rate of heat loss from molten steel in the head of the mould in order to keep this steel molten and thereby allow it to feed to the body of the ingot (and thus improve ingot quality) as the steel in the body of the ingot shrinks on cooling and solidification. The slabs may have exothermic properties in addition to their heat-insulating properties.

The slabs need to be held in their proper positions in the head of the mould and it is desirable to be able to vary the vertical position at which the slabs are to be held in the mould head. A wide variety of holding means have been proposed for holding the slabs in position, the holding means having a portion engageable with the top of the mould for hanging the slab in the mould head and a portion secured to the slab. Some of the known holding means permit variation of the vertical position of the slabs in the mould head. The known holding means all have one or more disadvantages: for example, the holding means may be difficult to manufacture, they may not permit adequate variation of the vertical position of the slabs in the mould head and they may hold the slabs insufficiently securely.

According to the present invention means for holding a hot top lining slab in the head of an ingot mould comprises a strap-receiving portion and a strap, either of these being securable to the slab, in which the strap-receiving portion includes a latch part extending towards the path of movement of the strap when received in the strap-receiving portion and the strap has disposed on a side thereof a plurality of spaced apart latching parts complementary to the latch part of the strap-receiving portion, with another side of the strap being free of such latching parts, whereby when a side of the strap free of latching parts is presented to the latch part of the strap-receiving portion the strap is free to move through that portion and when the strap is moved to present a side having the latching parts to the latch part of the strap-receiving portion the strap is caused to engage with the strap-receiving portion.

A hot top lining slab according to the invention for an ingot mould has holding means as described above, the strap-receiving portion or the strap, preferably the former, being secured to the slab. The strap preferably has at its upper end a hook for engaging the top of an ingot mould wall for hanging the slab in the mould head. Each slab preferably has two of the holding means.

Holding means of the invention can be made in forms that are easy to manufacture and are able to hold the slabs very securely. Furthermore, there is preferably a considerable number of the latching parts and they are preferably closely spaced and thus the vertical position of a slab in the mould head may be varied in fine steps between wide limits.

Whilst the strap-receiving portion or strap of the slab holding means may be secured to a surface of the slab, it is preferably wholly or partly embedded within the slab as this protects it from being dislodged or damaged during transport and handling of the slab, minimises any risk of it being dislodged during use of the slab and is generally advantageous for ease of packing together a number of the slabs for storage or transport. Whilst say the strap-receiving portion may be embedded in the slab, at least part of the other co-operating part of the slab holding means is outside the slab but this part may be movable into a position facilitating packing together a number of the slabs for storage or transport.

The strap-receiving portion and the strap of the slab holding means are preferably such that by rotation of the strap in the strap-receiving portion the strap can be brought in or out of engagement with the strap-receiving portion.

The strap of the slab holding means is preferably a generally L-shaped rod, e.g. of mild steel, the shorter arm of which is adapted to engage the top of the mould for hanging the slab and the longer arm of which has a plurality of longitudinally spaced latching parts, in the form of notches, in one side of its length. The strap-receiving portion is preferably a body e.g. of mild steel, having a latching tongue sprung up from its floor and upstanding end walls having aligned rod-receiving holes arranged to locate the tongue adjacent, or in, the path of movement of the rod. The latching tongue is resilient and is sprung against the notched arm of the rod. In use the tongue inclines downwardly to its free end and the free end is engageable with any of the notches in the rod and, by virtue of its downward inclination, it provides a very positive resistance to upward withdrawal of the rod when the projection is engaged with one of the notches. The holes in the two end walls permit free rotation and longitudinal movement of the notched arm of the rod but restrain lateral movement of that arm and thus prevent accidental disengagement of the tongue from a notch in the elongate portion of the hanger part. Preferably the length of the notched arm between its free end and the nearest notch is at least as great as the distance between the free end of the tongue and the lower side of the lower end wall so that even when the tongue engages the lowest notch the notched arm is within both the holes.

The invention includes not only the slab holding means and a hot top lining slab incorporating one or more of the means but also an ingot mould having in its head a hot top lining provided by a plurality of hot top slabs hung from the top of the mould by use of the means. The slabs incorporating the means may be made by attaching one or more of the means to a preformed slab or, preferably, by positioning one or more of the means in a mould and casting material to form the slab in the mould around the means, part at least of the strap-receiving portion or the strap being positioned beyond the material for the slab.

Figure 2:
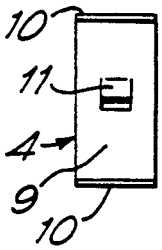
Figure 3:
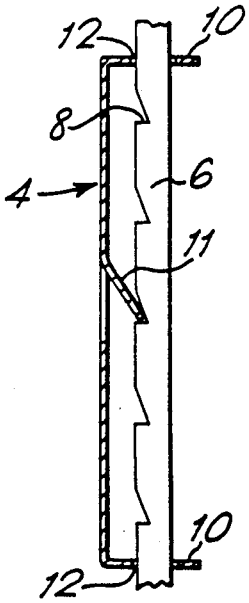

The invention is further described with reference to the accompanying drawings in which:

FIG. 1 is a vertical section through a hot top lining slab of the invention hanging in the head of an ingot mould, FIG. 2 is a view as seen from the right in FIG. 1 of the strap-receiving portion 4, FIG. 3 is an enlarged partial view of the strap-receiving portion 4.

Referring to FIG. 1 a refractory, heat-insulating hot top lining slab 1 is hung in position in the head of an ingot mould, the upper part of the wall of which is shown at 2. The slab 1 is hung in position by use of a slab holding means having a strap 3 and, wholly embedded in the slab, a strap-receiving portion 4.

The strap 3 is provided by a generally L-shaped rod having a shorter arm 5 engaging the top of the mould and a longer, vertically extending arm 6. At the end of the shorter arm 5 is a downward portion 7 engaging the outer surface of the mould wall.

On one side of most of its length the longer arm 6 has a plurality of longitudinally spaced latching parts in the form of notches 8. The lower face of each notch is generally horizontal whilst the upper face is inclined.

The strap-receiving portion 4 is in the form of a plate having a body portion 9 (FIG. 2) parallel to the plane of the slab 1 and at each end a bent over end wall 10 extending laterally on the same side. Struck out from the body portion 9 of the plate on the same side as the walls 10 is a downwardly inclined spring latching tongue 11 which, as best seen in FIG. 3, engages with one of the notches 8.

Each of the walls 10 has a hole 12 of slightly greater size than the cross section of the arm 6 and in which the arm 6 is free to rotate axially. By virtue of the passage of the arm 6 through the two apertures 12, the arm 6 is restrained from lateral movement and the tongue 11 is pressed against it.

The engagement of the end of the tongue 11 with one of the notches 8 provides very great resistance to withdrawal of the strap 3 from the strap-receiving portion 4 as the end of the downwardly inclined tongue bears against the generally horizontal lower surface of the notch 8.

To provide an assembly as shown in FIG. 1, the slab holding means and slab is initially taken in a condition where the arm 6 is in a position axially rotated in the slab by say 90° with respect to the position as shown in FIG. 1 and so a notch-free side is presented to the latching tongue 11. In such a position the tongue 11 is no longer engaged with the respective notch nor engageable with any of the other notches. Thus, once any initial bond between the arm 6 and the material of the slab has been broken (by axial rotation of the arm 6 in the slab), the arm 6 can readily be withdrawn to a predetermined extent from the slab or, if not already within the slab to its maximum extent, can be readily pushed in to a predetermined extent.

Once the arm 6 has been withdrawn or pushed in to the desired predetermined extent, the arm 6 is axially rotated by swinging the arm 5 to the position shown in FIG. 1 and the tongue 11 is then engaged in the nearest notch, if necessary by pulling the arm 6 out of the slab a short distance so that the end of the tongue engages in the notch rather than against a part of the arm 6 between the closely spaced notches. The slab is then hung in the mould head by engagement of the arm 5 and downward portion 7 with the top of the mould as shown in FIG. 1.

If inadvertently a slab is initially hung at an incorrect height, it can be removed with the slab holding means and the vertical position of the arm 6 in the slab further adjusted as described above. Engagement of the tongue 11 with the arm 6 damages neither so repeated adjustment is possible if necessary. Moreover after an ingot has been cast in the mould and the ingot separated from the mould, the parts of the slab holding means can be recovered from the slab and reused.

If desired, the strap-receiving portion may have more than one latch part e.g. of the nature of the tongue 11 and these may be spaced apart by the distance between any two of the latching parts e.g. the notches 8 for simultaneous engagement or by a different distance so that if one engagement fails another will take over after a small vertical movement of the strap-receiving portion in relation to the strap.

In order to provide positive resistance to the Archimedean upthrust on the slab when molten steel teemed into the mould reaches the level of the slab, the arm 6 of the strap 3 can be provided on the side opposite to that having the notches 8 with a generally similar succession of notches, but these notches having a generally horizontal upper face and an inclined lower face, and the strap-receiving portion can be elaborated to include a tongue generally similar to the tongue 11 but on the opposite side of the arm 6 and upwardly inclined. In this way resistance to upward movement of the slab in relation to the arm 6 can be provided whilst retaining the ability to disengage the strap from the strap-receiving portion by rotation of the strap in the strap-receiving portion. Resistance to upward movement of the slab together with the holding means can be achieved by securing the arm 5 to the top of the mould e.g. by placing a weight on the arm 5.

We claim:

1. An ingot mould having in its head a hot top lining provided by a plurality of hot top lining slabs hung from the top of the mould, wherein each of said slabs includes at least one holding means for hanging said slab from the top of the mould, said at least one holding means comprising:

a generally L-shaped strap having shorter and longer arms, the shorter arm of which is engaged with the top of the mould for hanging the slab, and the longer arm of which includes means defining a plurality of longitudinally spaced-apart notches; and strap-receiving means secured to the slab and defining an elongated cavity in which said longer arm is received to be longitudinally movable between upper and lower positions as well as rotatable between latched and unlatched positions, said strap-receiving means including, (a) a substantially planar side wall disposed substantially parallel to said elongated cavity and having a resilient latching tongue means inwardly disposed in a direction towards said cavity, one end of said tongue means fixed to said side wall and the other end being engaged with a predetermined one of said notches when said longer arm is rotated to said latched position, said tongue means being downwardly inclined between said one and other ends in the direction of longitudinal movement of said longer arm when said longer arm is moved from said upper position to said lower position, and (b) a pair of spaced apart end walls each being disposed substantially transverse to said elongated cavity and defining an aperture in alignment with said elongated cavity thereby permitting said longer arm to pass therethrough, said strap-receiving means permitting said longer arm to freely move longitudinally within said cavity between said upper and lower positions when rotated to said unlatched position and for permitting said other end of said tongue means to engage a predetermined one of said notches when said longer arm is rotated to said latched position, and said tongue means for resiliently biasing said longer arm against upward movement in said engaged position to restrain said longer arm in said cavity and to hold the hot top lining slab in the head of the ingot mould.

2. A device for holding a hot top lining slab in the head of an ingot mould comprising:

a generally L-shaped strap having shorter and longer arms, the shorter arm of which is engageable with the top of the mould for hanging the slab and the longer arm of which includes means defining a plurality of longitudinally spaced-apart notches; and strap-receiving means securable to the slab and defining an elongated cavity in which said longer arm is received to be longitudinally movable between upper and lower positions as well as rotatable between latched and unlatched positions, said strap-receiving means including, (a) a substantially planar side wall disposed substantially parallel to said elongated cavity and having a resilient latching tongue means inwardly disposed in a direction towards said cavity, one end of said tongue means fixed to said side wall and the other end being engaged with a predetermined one of said notches when said longer arm is rotated to said latched position, said tongue means being downwardly inclined between said one and other ends in the direction of longitudinal movement of said longer arm when said longer arm is moved from said upper position to said lower position, and (b) a pair of spaced apart end walls each being disposed substantially transverse to said elongated cavity and defining an aperture in alignment with said elongated cavity thereby permitting said longer arm to pass therethrough, said strap-receiving means permitting said longer arm to freely move longitudinally within said cavity between said upper and lower positions when rotated to said unlatched position and for permitting said other end of said tongue means to engage a predetermined one of said notches when said longer arm is rotated to said latched position, and said tongue means for resiliently biasing said longer arm against upward movement in said engaged position to restrain said longer arm in said cavity and to hold the hot top lining slab in the head of an ingot mould.

3. A device as in claim 2 wherein each of said notches includes a first substantially horizontal surface extending from the exterior of said longer arm to an interior area located therein and an inclined surface being inwardly inclined from an area located above said horizontal surface on the exterior of said longer arm to said interior area.

4. In combination, a hot top lining slab, and a device for holding the slab in the head of an ingot mould, said device comprising:

a generally L-shaped strap having shorter and longer arms, the shorter arm of which is engageable with the top of the mould for hanging the slab and the longer arm of which includes means defining a plurality of longitudinally spaced-apart notches; and strap-receiving means secured to the slab and defining an elongated cavity in which said longer arm is received to be longitudinally movable between upper and lower positions as well as rotatable between latched and unlatched positions, said strap-receiving means including, (a) a substantially planar side wall disposed substantially parallel to said elongated cavity and having a resilient latching tongue means inwardly disposed in a direction towards said cavity, one end of said tongue means fixed to said side wall and the other end being engaged with a predetermined one of said notches when said longer arm is rotated to said latched position, said tongue means being downwardly inclined between said one and other ends in the direction of longitudinal movement of said longer arm when said longer arm is moved from said upper position to said lower position, and (b) a pair of spaced apart end walls each being disposed substantially transverse to said elongated cavity and defining an aperture in alignment with said elongated cavity thereby permitting said longer arm to pass therethrough, said strap-receiving means permitting said longer arm to freely move longitudinally within said cavity between said upper and lower positions when rotated to said unlatched position and for permitting said other end of said tongue means to engage a predetermined one of said notches when said longer arm is rotated to said latched position, and said tongue means for resiliently biasing said longer arm against upward movement in said engaged position to restrain said longer arm in said cavity and to hold the hot top lining slab in the head of an ingot mould.

5. The combination according to claim 4 in which the strap-receiving means is embedded in the slab.

* * * * *